US007249828B2

(12) United States Patent
Gelbart et al.

(10) Patent No.: US 7,249,828 B2
(45) Date of Patent: Jul. 31, 2007

(54) METHOD AND APPARATUS FOR CONTROLLING CHARGING OF DROPLETS

(75) Inventors: Daniel Gelbart, Vancouver (CA); David Scott Bruce, Delta (CA); Thomas W. Steiner, Burnaby (CA)

(73) Assignee: Kodak Graphic Communications Canada Company, Bristish Columbia (CA)

( * ) Notice: Subject to any disclaimer, the term of this patent is extended or adjusted under 35 U.S.C. 154(b) by 318 days.

(21) Appl. No.: 11/080,635

(22) Filed: Mar. 16, 2005

(65) Prior Publication Data

US 2005/0206688 A1 Sep. 22, 2005

Related U.S. Application Data

(60) Provisional application No. 60/553,526, filed on Mar. 17, 2004.

(51) Int. Cl.
*B41J 2/07* (2006.01)

(52) U.S. Cl. ..... 347/74

(58) Field of Classification Search ..... 347/74, 347/76, 77, 75, 80

See application file for complete search history.

(56) References Cited

U.S. PATENT DOCUMENTS 3,761,941 A 9/1973 Robertson
3,898,673 A 8/1975 Haskell
3,969,733 A 7/1976 DeMoss et al.
4,060,813 A * 11/1977 Yamada et al. ..... 347/80
4,288,796 A 9/1981 Aiba et al.
4,418,352 A 11/1983 Horike et al.
4,470,052 A 9/1984 Lovelady
6,206,509 B1 3/2001 Lecheheb et al.
6,325,494 B1 12/2001 Lecheheb et al.
6,474,793 B1 * 11/2002 Van Kempen et al. ..... 347/74
6,511,164 B1 * 1/2003 Bajeux ..... 347/74
7,104,634 B2 * 9/2006 Weksler et al. ..... 347/78

OTHER PUBLICATIONS

International Search Report for PCT/CA2005/000404, International Searching Authority, Jul. 6, 2005, pp. 1-3.

* cited by examiner

*Primary Examiner*—K. Feggins

(57) ABSTRACT

An apparatus for controlling droplets allows the phase difference between a calibration signal and its signature signal on a detector to be minimized, or the amplitude of the signature signal to be maximized, by adjusting the droplet charging means of the device, or the droplet generation means, and the signals on either. The apparatus converts a stream of fluid into a stream of droplets under the influence of a droplet stimulation signal imposed onto the droplet generating means. Droplets are subsequently signal-wise charged under the influence of a droplet charging signal imposed on the droplet charging means. The charged droplets are then deflected. The calibration signal is imposed onto the stream of droplets. The calibration signal has characteristics that do not appreciably affect the trajectory of the stream of droplets, thereby ensuring that the placement accuracy of the individual droplets is a maintained. The calibration signal further has a signal phase that is independent of the droplet charging signal. A charge detection means is used to extract a charge detection signal from the at least a part of the droplets. The charge detection signal is filtered to extract a signature signal of the calibration signal. The phase control system then varies at least one of the droplet generation means, droplet stimulation signal, droplet charging means and droplet charging signal until the phase between the signature signal and the calibration signal is minimized. A plurality of streams of droplets may be controlled by the method of the invention.

34 Claims, 1 Drawing Sheet

METHOD AND APPARATUS FOR CONTROLLING CHARGING OF DROPLETS

RELATED APPLICATIONS

This application claims the benefit of the filing date of U.S. application Ser. No. 60/553,526 filed 17 Mar. 2004 which is hereby incorporated herein by reference.

FIELD OF THE INVENTION

The invention pertains to the field of fluid droplet generation and selective application and, in particular, to the control of the process for charging of droplets in continuous inkjet systems.

BACKGROUND OF THE INVENTION

One of two methods, drop-on-demand or continuous, is typically employed in an apparatus that generates and selectively applies droplets. An example of such an apparatus is a continuous inkjet printer that generates and selectively applies droplets to a substrate to create a printed article. Further examples include inkjet-based computer-to-plate devices that generate and selectively apply droplets to a printing plate. Such apparatus either impart the necessary plate image printing characteristics required to successfully print, or produce a mask on a printing plate, which then undergoes additional operations to impart the necessary plate image printing characteristics that are required to successfully print.

A drop-on-demand apparatus, as its name implies, selectively generates droplets only when specifically needed. A continuous apparatus, on the other hand, continuously generates a stream of droplets from an uninterrupted stream of fluid, regardless of whether the droplets are specifically needed or not. Unlike a drop-on-demand apparatus, a continuous apparatus typically incorporates an ability to select specific droplets from the stream of droplets so that the selective application or selective use of these specific droplets can be accomplished. A common method of selecting these specific droplets from the rest of the droplets that are not required for subsequent application or subsequent use involves selectively charging some of the droplets and then using an electric field to discriminate between charged and non-charged droplets. Once selectively charged, either charged, or non-charged droplets may be applied to a substrate or used in some other application specific manner. In either case, charged droplets are deflected in an electric field, either to be applied to a substrate, or to be used in some application specific manner, or to be discarded into a disposal means typically referred to as a gutter.

In the case where charged droplets are applied to a substrate or used in some application specific manner, the charged droplets are deflected by an electric field to be applied or used, while the uncharged droplets maintain their original trajectory to be collected in a gutter. In this case, the amount of charge on the droplet determines the amount of movement of the droplets in the electric field. Such droplet movement may determine the relative position of the droplets that are applied to the substrate, for example.

In the case where the uncharged droplets are applied to a substrate or are used in some application specific manner, the charged droplets are deflected by an electric field into a gutter, while the uncharged droplets maintain their original trajectory to be applied to the substrate or to be used in some further fashion.

Typical continuous apparatus are equipped with a droplet generator that creates a stream of droplets. One type of droplet generator used in a typical continuous apparatus converts a continuous filament of fluid into a continuous stream of droplets. Various methods exist and are employed to change a continuous filament of fluid into a continuous stream of droplets. Most often such methods involve the application of an electrical stimulation signal to a suitable transducer in order effect some form of natural oscillation in the liquid, thereby facilitating the breakup of the liquid filament into individual droplets. It is common practice to employ a sinusoidal electrical signal of fixed wavelength for this purpose.

The stream of fluid breaks up into individual droplets at a distance (or time) from the point of origin of the stream of fluid commonly referred to as the "break-off point". This break-off point is dependent on a number of parameters, including velocity, temperature, and fluid viscosity.

To create the appropriate charge on the droplets, the signal used for charging the droplets is usually applied to the stream of fluid before the moment the droplet separates from the stream, and held until the droplet is free of the stream. It is therefore clear that the phase relationship between the droplet stimulation signal and the droplet charging signal helps to determine the charge levels on the droplets.

The prior art describes a variety of ways to establish and control this phase relationship. One category of devices seeks to determine maximum charging of droplets by monitoring the current consumed by the droplets as they break-off from the drop generator. A second category of devices is based on sensing in a variety of ways the charge on either individual droplets or streams of droplets somewhere along their path of travel or at some collection point.

Yet a further family of methods employs a calibration signal that is applied to the droplets, typically at the charge electrode. In the prior art, this calibration signal is required to have a fixed phase or timing relationship with the charging signal or the droplet stimulation signal. The signature of the calibration signal produced by the droplets at some later point along their path, most typically measured at the droplet collection point or induced in a sensor of some form, is analyzed, and the relationship between the signature signal and the original calibration signal is then used to control the optimum droplet charging conditions.

The prior art systems which make use of calibration signals to control the charge levels on droplets make a specific point of applying the calibration signal selectively to specific droplets, depending on whether they are to be used for printing or not.

The prior art systems which make use of calibration signals to control the charge levels on droplets all share a common problem, in that they require complex timing arrangements in order establish the exact relationship between the calibration signal and droplet charging signal. There therefore remains a need for a simple and reliable means to control the charging of a stream of droplets.

SUMMARY OF INVENTION

Aspects of the present invention are directed to methods and apparatus for controlling the charging of selected droplets within a stream of droplets. The apparatus comprises a droplet generation means, capable of stimulating a filament of fluid in accordance with a droplet stimulation signal to thereby cause the filament to break up into a plurality of droplets at a droplet break-off point. The apparatus further comprises a droplet charging means located proximate the droplet break-off point and capable of inducing an electrical charge on the plurality of droplets in accordance with a droplet charging signal, to create thereby a plurality of signal-wise charged droplets. The apparatus furthermore comprises a droplet charge sensing means and a droplet deflection means. The droplet deflection means is capable of deflecting at least a part of the plurality of signal-wise charged droplets towards the droplet charge sensing means in accordance with the electrical charge on the plurality of signal-wise charged droplets.

The degree of deflection of particular droplets is governed by the amount of charge that has been induced on the particular droplets. Maximal induced charge, or induced charge within a small operational threshold of the maximal value, may ensure the accurate and most efficient deflection of the individual droplets. A particular phase relationship between the droplet stimulation signal and the droplet charging signal helps to secure maximal induced charge levels. The establishment of this phase relationship is facilitated by imposing a calibration signal onto the stream of individual droplets. The calibration signal is generated by a calibration signal generation means and has characteristics that do not appreciably affect the trajectory of the stream of individual droplets, thereby ensuring that the placement accuracy of the individual droplets is maintained. The calibration signal further has a calibration signal phase that is independent of the droplet charging signal and, more particularly, independent of the droplet charging signal phase. A charge detection means is used to extract a charge detection signal from the individual deflected droplets. The charge detection signal is filtered to extract a signature signal of the calibration signal. The desired phase relationship between the droplet stimulation signal and the droplet charging signal may be achieved by varying at least one of the droplet generation means, the droplet stimulation signal, the droplet charging means and the droplet charging signal in order to minimize the phase difference between the signature signal and the calibration signal. This process may be automated to maintain the phase difference between the signature signal and the calibration signal at a minimum value. In this process the time of flight of the deflected droplets may be minimized.

A plurality of streams of droplets may be controlled by the methods and apparatus of the invention.

Further aspects of the invention and features of specific embodiments of the invention are described below.

BRIEF DESCRIPTION OF DRAWINGS

In drawings, which illustrate non-limiting embodiments of the invention.

DETAILED DESCRIPTION

Figure 1:
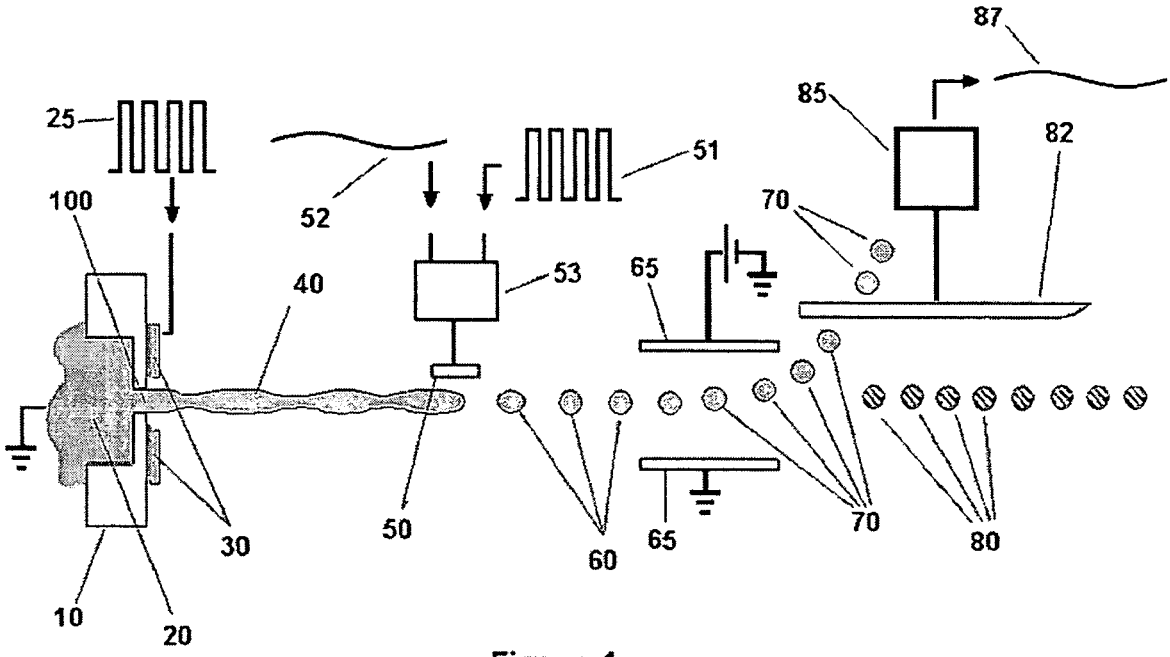
FIG. 1 is a schematic drawing of an apparatus to control droplets in accordance with a particular embodiment of the invention, showing droplet stimulation, charging and deflection means and further depicting their associated signals.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

FIG. 1 shows a preferred embodiment of the present invention as an apparatus capable of performing the method of the invention. Fluid 20 is delivered under pressure to a fluid manifold 10 and jetted under pressure through nozzle 100, producing a column of fluid as a filament 40. Upon exiting nozzle 100, filament 40 passes stimulation electrodes 30, which have imposed upon them droplet stimulation signal 25. The presence of stimulation signal 25 on stimulation electrodes 30 causes the filament to break up into a stream of droplets 60 in a controlled manner at a point called the "break-off point". In order to efficiently charge droplets 60, charging electrodes 50 are preferably positioned at or near the break-off point.

In this embodiment of the invention, droplets may be charged by applying droplet charging signal 51 via charging electrode driver 53 to charging electrodes 50. Some droplets will receive a charge in this process, while others do not, thereby creating a population of charged droplets within the stream of droplets 60. Droplet charging signal 51 is generated by a droplet charging signal generation means and has the same frequency as droplet stimulation signal 25. This may be obtained by employing a common clock for these two signals. In practical application, droplet stimulation signal 25, which is shown schematically as a square wave in FIG. 1, is preferably sinusoidal, or near sinusoidal. Further, droplet stimulation signal 25 can be a combined signal of one or more different signals. Droplet charging signal 51, also shown as a square wave, may have a variety of forms to facilitate the charging of the droplets. Clearly, charging pulses will be absent from droplet charging signal 51 when droplets that are not to be charged are transition the charging electrodes 50. Therefore droplets are signal-wise charged as per the waveform composition of droplet charging signal 51. After some further distance of travel, the droplets, if charged by droplet charging signal 51, will be deflected by deflection electrodes 65. These deflected droplets are shown as droplets 70 in FIG. 1. If droplets are not charged by droplet charging signal 51, they proceed along their original path and are shown as undeflected droplets 80. In the illustrated embodiment, deflection electrodes 65 are employed as a droplet deflection means. Droplet deflection means can include any device capable of deflecting the charged droplets, including charging electrodes 50.

In FIG. 1, time-of-flight sensor 82 is employed as a charge detection means and is capable of sensing the arrival of deflected droplets 70. A variety of time-of-flight sensors exist and may be employed. Such time-of-flight sensors include sensors that collect deflected droplets 70, thereby measuring their charge, and non-contact sensors that allow deflected droplet to pass unimpeded, while still sensing their charge by capacitive or inductive means, for example. For the sake of clarity, time-of-flight sensor 82 is shown schematically in FIG. 1 as an elongated plate. The position at which deflected droplets 70 are sensed by time-of-flight sensor 82 is fundamentally determined by the degree of deflection that the deflected droplets 70 undergo. The size of the charge induced on deflected droplets 70 by droplet charging signal 51 in turn determines the degree of deflection. For example, if the charge on deflected droplets 70 is high, the deflected droplets 70 are sensed by time-of-flight sensor 82 earlier along their trajectory, while if the charge on deflected droplets 70 is low, then the deflection is lesser and the deflected droplets 70 are sensed by time-of-flight sensor 82 later along their trajectory. Thus, the time of flight required to allow deflected droplets 70 to be sensed by time-of-flight sensor 82 is an indicator of the size of charge that has been induced on deflected droplets 70. The maximum charge on the droplets will correspond to the minimum time of flight of the deflected droplets.

The phase relationship between the droplet stimulation signal 25 and droplet charging signal 51 helps to secure maximal, or very near maximal, charge levels on droplets. Because many factors influence the formation and propagation of the droplets, it is necessary to adjust either or both of charge electrodes 50 or droplet charging signal 51, on the one hand, or the droplet generating means or droplet stimulation signal 25, on the other hand.

In the present specification, the term "droplet generation means" is used to describe an apparatus that is capable of imparting an oscillating nature to a fluid stream, such that droplets subsequently form. The term "droplet charging means" is used to describe an apparatus that is capable of signal-wise applying charges to droplets.

Returning now to FIG. 1, a calibration signal 52 is applied via charging electrode driver 53 to charging electrodes 50. Calibration signal 52 is generated by a calibration signal generation means that is independent of the clock cycle of the droplet charging signal generation means. Calibration signal 52 has a calibration signal frequency that is much smaller than the frequency of droplet charging signal 51. Calibration signal 52 also has a calibration signal amplitude that is much smaller than the amplitude of droplet charging signal 51. In practice, the amplitude of calibration signal 52 is low enough, such that when it is applied to droplets, it does not appreciably affect their trajectory, thereby ensuring that the placement accuracy of droplets is maintained. Thus, within the specifications of the invention, the application of calibration signal 52 to uncharged droplets will leave them for all intended purposes, uncharged. The phase of calibration signal 52, herein referred to as the "calibration signal phase", is independent of the phase of droplet charging signal 51, herein referred to as the "droplet charging signal phase". Further, although in a preferred embodiment of the present invention, calibration signal 52 is sinusoidal or near sinusoidal, it is not limited to this waveform.

The frequency of the calibration signal is preferably less than 5% of the frequency of the droplet charging signal and more preferably less than 1% of the frequency of the droplet charging signal. The amplitude of the calibration signal is preferably less than 1% of the amplitude of the droplet charging signal. By way of example, the frequency of droplet charging signal 51 can be chosen to be between 10 kHz and 1.5 MHz and its amplitude may be selected to be some value in the range of 50V-150 V. By comparison, calibration signal 52 may be chosen to have a calibration signal frequency between 300 Hz and 10 kHz, and a calibration signal amplitude between 1 mV and 150 mV. In these examples, the calibration signal frequency and the calibration signal amplitude are at least an order of magnitude smaller than the respective frequency and amplitude of droplet charging signal 51. Therefore, it is concluded that the calibration signal frequency and the calibration signal amplitude are respectively much smaller than the frequency and amplitude of the droplet charging signal.

In a preferred embodiment, the signal induced in time-of-flight sensor 82 by deflected droplets 70, herein referred to as the "charge detection signal", is monitored and suitably filtered by filter 85 to extract that component of the charge detection signal that has the same frequency as calibration signal 52. This component will be composed of the signature signal 87 of calibration signal 52 plus any extraneous signal that may occasionally occur within the passband of the filter 85. Such an extraneous signal may arise, for example, from a rare occasion in which a particular pulse composition of droplet charging signal 51 waveform substantially matches the waveform of calibration signal 52. It should be noted that this situation does not pose a limitation to the invention, since these particular components of droplet charging signal 51 are uncorrelated to calibration signal 52 and can be easily filtered out over a suitably chosen time scale. The phase of signature signal 87 is directly determined by the time of flight of deflected droplets 70 that are sensed by time-of-flight sensor 82. The larger the charge on a given deflected droplet 70, the shorter its time of flight to induce a signal in time-of-flight sensor 82, and the smaller the phase difference between signature signal 87 and calibration signal 52. In view of this, the phase difference between signature signal 87 and calibration signal 52 is a direct indicator of the degree of charging on droplets.

The period of calibration signal 52 is chosen to be greater in duration than the maximum variation in the time of flight of deflected droplets 70 from their break-off point to their arrival at the time-of-flight sensor 82, in order that the phase delay induced by the variation in time of flight of deflected droplets 70 does not exceed one period of calibration signal 52, thereby ensuring that the phase measurement is a deterministic measurement of variation in time of flight.

Particular pulse compositions of the droplet charging signal 51 waveform may have the effect of causing dropouts in signature signal 87, but this effect can be mitigated by the suitable and/or automated choice of filter 85 passband frequencies.

In one particular embodiment, droplet stimulation signal 25 is kept constant while the phase of droplet charging signal 51 is varied to optimize droplet charging. In this process, the magnitude of the charge on the droplet transition charge electrodes 50 increases to reach a maximum at some particular phase setting (i.e. when the phase difference between droplet stimulation signal 25 and droplet charging signal 51 has a particular value). If the phase of droplet charging signal 51 is varied beyond this point, the charge on a droplet transition charging electrodes 50 decreases again from the maximum. Correspondingly, as this adjustment is made to droplet charging signal 51, the phase difference between signature signal 87 and calibration signal 52 decreases to a minimum (when the charge on the droplets is a maximum) and then increases again as the charge on the droplets is decreased from their maximum level. This allows all the benefits of a phase measurement system that is not fundamentally dependent on the measurement of small amplitude signals. In a more generalized embodiment, calibration signal 52 is not applied specifically at charge electrodes 50, but is applied at any general point before time-of-flight sensor 82. This may include applying calibration signal 52 to fluid 20 in fluid manifold 10, to fluid manifold 10 itself, in or to nozzle 100, to stimulation electrodes 30, to the charge electrodes 50 (as already described), to deflection electrodes 65, or using any other additional set of electrodes positioned anywhere in the system, so long as calibration signal 52 can be physically applied to the droplets before the moment they break-off from the filament at the break-off point.

In other preferred embodiments of the present invention, the phase difference between signature signal 87 and calibration signal 52 is minimized while adjusting any one or more of: the droplet generation means, the phase or amplitude of droplet stimulation signal 25, the droplet charging means, and the phase of droplet charging signal 51.

From the above description, it is clear that deflected droplets 70 can be chosen to be either applied to a substrate or to be used in some other application specific manner, or to be eventually discarded, as the apparatus dictates. In a preferred embodiment, time-of-flight sensor 82 may be all or part of a droplet guttering system.

In one preferred embodiment, charged droplets are applied to a substrate or are used in some other application specific manner, while uncharged droplets maintain their original trajectory to be collected in a gutter. In such an embodiment, the amount of charge on the charged droplet is optimized by the phase-based method of the present invention.

In another preferred embodiment, uncharged droplets are applied to a substrate or are used in some other application specific manner, while charged droplets are deflected by an electric field into a gutter. In such an embodiment, the amount of charge on the charged droplet is optimized by the phase-based method of the present invention.

In a preferred embodiment, droplets are selectively charged with charges of different polarity. Droplets charged with a particular polarity are deflected by an electric field to be applied to a substrate or to be used in some application specific manner, while droplets charged with an opposite polarity are deflected for a secondary application or use, or to be discarded into a gutter. In such an embodiment, the charging of the droplets is optimized jointly or separately for the negatively and positively charged droplets. In this respect, a sub-population of the population of charged droplets is deflected to the charge detection means.

Clearly, the method of the present invention may be automated by feeding the phase difference between signature signal 87 and calibration signal 52 (or any combination of signals indicative of this phase difference) back to an adjustment means, such as a systems controller, for adjusting automatically or manually any one or more of: the droplet generation means, droplet stimulation signal 25, the droplet charging means, and droplet charging signal 51. Suitable circuitry for adjusting the phase of droplet charging signal 51, or the phase or amplitude of droplet stimulation signal 25 is well known and is not discussed any further here. Adjustments to the droplet generation means and the droplet charging means can be accomplished servo-mechanically based on the same feedback signal.

Given the fact that no direct relationship exists between the phase of calibration signal 52 and the phase of droplet charging signal 51, calibration signal 52 is typically applied continuously. By virtue of its small amplitude, calibration signal 52 does not interfere with the trajectory of deflected droplets 70 or undeflected droplets 80, as the case may be. Thus, the present invention allows the real time optimization of the droplet charging process. In other words, the optimization of the droplet charging process can occur simultaneously with the application of droplets to a substrate, or with the use of the droplets for some other application specific manner, said droplets being charged or uncharged as deemed by the architecture of the system. If so desired, calibration signal 52 may be switched off when droplets are being applied to a substrate or used in some other application specific manner. Calibration signal 52 could then be applied in a calibration mode only during times when the apparatus is not applying droplets to a substrate or using droplets in an application specific manner.

The invention can further be expanded to include methods and apparatus that generate a plurality of continuous streams of droplets. Each of the streams of droplets in this more generalized embodiment may have associated with it, every one of the means disclosed above. In an alternative embodiment of this more generalized implementation of the present invention, some of the droplet streams may share some of the disclosed means.

In a preferred embodiment of the present invention, a method for controlling the charging of droplets comprises generating a first plurality of streams of droplets and then applying a corresponding droplet charging signal to each of the streams of droplets, each droplet charging signal having a droplet charging signal amplitude, a droplet charging signal phase and a droplet charging signal frequency, thereby creating a population of charged droplets in each stream of droplets. A corresponding third plurality of calibration signals is imposed on each of a second plurality of streams of droplets, the second plurality being a subset of the first plurality, each of the third plurality of calibration signals having a calibration signal frequency, a calibration signal amplitude and a calibration signal phase, and each calibration signal phase being independent of any of the droplet charging signals. At least a sub-population of charged droplets is deflected from each stream of the first plurality to a charge detection means where a fourth plurality of signature signals is obtained, the fourth plurality of signature signals corresponding to the third plurality of the calibration signals. Each of the fourth plurality of signature signals has a signature signal frequency, a signature signal amplitude and a signature signal phase, the signature signal frequency of each member of the fourth plurality being equal to the calibration signal frequency of the corresponding member of the third plurality. The charge on the population of charged droplets in each stream of the first plurality of streams of droplets is then maximized based on the difference between the signature signal phase of at least one member of the fourth plurality and the calibration signal phase of the corresponding member of the third plurality. In particular, maximizing the charge on the population of charged droplets may comprise minimizing the difference between the signature signal phase of at least one member of the fourth plurality and the calibration signal phase of the corresponding member of the third plurality. In this process the time of flight may be minimized for each droplet in each member of the second plurality of streams of droplets.

Further, additional quality improving means can be employed to provide other additional benefits that may enhance the efficacy of the invention. By way of example, this may include "guard drop" schemes that minimize cross talk effects in such systems. The optimization of the droplet charging process can be accomplished selectively with respect to each continuous stream of droplets. Alternatively, the optimization can be accomplished by employing the average of the signature signals detected from each of at least a part of the plurality of continuous streams of droplets.

While the present invention clearly lends itself to continuous inkjet printing, as well as to inkjet-based computer-to-plate manufacture, it is not limited to such applications. In general, the invention may be used in any application(s) requiring the generation and selective application or use of fluid droplets.

There have thus been outlined the important features of the invention in order that it may be better understood, and in order that the present contribution to the art may be better appreciated. Those skilled in the art will appreciate that the conception on which this disclosure is based may readily be utilized as a basis for the design of other methods and apparatus for carrying out the several purposes of the invention. It is most important, therefore, that this disclosure be regarded as including such equivalent methods and apparatus as do not depart from the spirit and scope of the invention.

What is claimed is:

1. A method for controlling charging of droplets, the method comprising:

a. generating a stream of droplets;

b. applying a droplet charging signal to the stream of droplets, the droplet charging signal having a droplet charging signal amplitude, a droplet charging signal phase and a droplet charging signal frequency, thereby creating a population of charged droplets in the stream of droplets;

c. imposing a calibration signal on the stream of droplets, the calibration signal having a calibration signal frequency, a calibration signal amplitude and a calibration signal phase, the calibration signal phase being independent of the droplet charging signal;

d. deflecting for charge detection at least a sub-population of charged droplets from among the population of charged droplets;

e. obtaining, from the sub-population of charged droplets, a signature signal of the calibration signal, the signature signal having a signature signal frequency, a signature signal amplitude and a signature signal phase, the signature signal frequency being equal to the calibration signal frequency; and f. maximizing the charge on the population of charged droplets based on the difference between the signature signal phase and the calibration signal phase.

2. A method as in claim 1, wherein maximizing the charge comprises minimizing of the difference between the signature signal phase and the calibration signal phase.

3. A method as in claim 2, wherein generating the stream of droplets comprises using a droplet stimulation signal and minimizing the difference between the signature signal phase and the calibration signal phase comprises adjusting at least one of: the phase of the droplet stimulation signal, the amplitude of the droplet stimulation signal, and the droplet charging signal phase.

4. A method as in claim 3, wherein adjusting at least one of: the phase of the droplet stimulation signal, the amplitude of the droplet stimulation signal, and the droplet charging signal phase is performed automatically.

5. A method as in claim 2, wherein minimizing the difference between the signature signal phase and the calibration signal phase is done while at least a part of the stream of droplets is being applied to a substrate.

6. A method as in claim 1, wherein the sub-population of charged droplets is substantially similar to the population of charged droplets in the stream of droplets.

7. A method as in claim 1, wherein the calibration signal frequency is less than 5% of the droplet charging signal frequency.

8. A method as in claim 1, wherein the calibration signal is imposed on the stream of droplets at the same point as where the droplet charging signal is applied.

9. A method as in claim 1, wherein at least a part of the population of charged droplets is applied to a substrate.

10. An apparatus for generating charged droplets, the apparatus comprising:

a. a droplet generation means capable of generating a stream of droplets based on a droplet stimulation signal;

b. a droplet charging means capable of applying to the stream of droplets a droplet charging signal having a droplet charging signal amplitude, a droplet charging signal phase and a droplet charging signal frequency, thereby creating a population of charged droplets in the stream of droplets; and c. a calibration signal generation means capable of generating a calibration signal for application to the stream of droplets, the calibration signal having a calibration signal frequency, a calibration signal amplitude and a calibration signal phase, wherein the calibration signal phase is independent of the droplet charging signal.

11. The apparatus of claim 10, further comprising:

a. a charge detection means capable of extracting from charged droplets a signature signal of the calibration signal, the signature signal having a signature signal amplitude, a signature signal frequency and a signature signal phase;

b. at least one charged droplet deflection means capable of deflecting to the charge detection means at least a sub-population of charged droplets from among the population of charged droplets; and c. an adjustment means capable of adjusting at least one of:

i. the droplet generation means;

ii. the droplet stimulation signal amplitude;

iii. the droplet stimulation signal phase;

iv. the droplet charging means; and v. the droplet charging signal phase;

in order to minimize a difference between the signature signal phase and the calibration signal phase.

12. The apparatus of claim 11, wherein the sub-population of charged droplets is substantially similar to the population of charged droplets in the stream of droplets.

13. The apparatus of claim 11, wherein the apparatus automatically minimizes a difference between the signature signal phase and the calibration signal phase while the apparatus is being used to deposit droplets on a surface.

14. The apparatus of claim 11, wherein the apparatus is capable of applying at least a part of the population of charged droplets to a substrate.

15. The apparatus of claim 11, wherein the adjustment means is capable of automatically adjusting at least one of:

a. the droplet generation means;

b. the droplet stimulation signal amplitude;

c. the droplet stimulation signal phase;

d. the droplet charging means; and e. the droplet charging signal phase.

16. The apparatus of claim 11, wherein at least one of the droplet generation means and the droplet charging means is adjusted servo-mechanically.

17. The apparatus of claim 11, wherein the droplet charging means and the droplet deflection means are the same means.

18. The apparatus of claim 10, wherein the calibration signal frequency is less than 5% of the droplet charging signal frequency.

19. The apparatus of claim 10, wherein the calibration signal is applied to the stream of droplets at the same point as where the droplet charging signal is applied.

20. An apparatus for generating charged droplets, the apparatus comprising:

a. a droplet generation means capable of generating a stream of droplets based on a droplet stimulation signal;

b. a droplet charging means capable of applying to the stream of droplets a droplet charging signal having a droplet charging signal amplitude, a droplet charging signal phase and a droplet charging signal frequency, thereby creating a population of charged droplets in the stream of droplets;

c. a calibration signal generation means capable of generating a calibration signal for application to the stream of droplets, the calibration signal having a calibration signal frequency, a calibration signal amplitude and a calibration signal phase, the calibration signal phase being independent of the droplet charging signal;

d. a charge detection means capable of extracting from charged droplets the signature signal of the calibration signal, the signature signal having a signature signal amplitude, a signature signal frequency and a signature signal phase;

e. at least one charged droplet deflection means capable of deflecting to the charge detection means at least a sub-population of charged droplets from among the population of charged droplets, the deflected droplets thereby having a time of flight to reach the charge detection means; and f. an adjustment means capable of minimizing the time of flight of the at least a sub-population of charged droplets by adjusting at least one of:

i. the droplet generation means;

ii. the droplet stimulation signal amplitude;

iii. the droplet stimulation signal phase;

iv. the droplet charging means; and v. the droplet charging signal phase.

21. The apparatus of claim 20, wherein the adjustment means is capable of minimizing the time of flight by minimizing a difference between the signature signal phase and the calibration signal phase.

22. The apparatus of claim 20, wherein the sub-population of charged droplets is substantially similar to the population of charged droplets in the stream of droplets.

23. The apparatus of claim 20, wherein the calibration signal frequency is less than 5% of the droplet charging signal frequency.

24. The apparatus of claim 20, wherein the calibration signal is applied to the stream of droplets at the same point as where the droplet charging signal is applied.

25. The apparatus of claim 20, wherein the adjustment means is capable of automatically adjusting at least one of:

a. the droplet generation means;

b. the droplet stimulation signal amplitude;

c. the droplet stimulation signal phase;

d. the droplet charging means; and e. the droplet charging signal phase;

and wherein at least one of the droplet generation means and the droplet charging means is adjusted servo-mechanically.

26. The apparatus of claim 20, wherein the droplet charging means and the droplet deflection means are the same means.

27. A method for controlling the charging of droplets, the method comprising:

a. generating a first plurality of streams of droplets;

b. applying a corresponding droplet charging signal to each of the streams of droplets, each droplet charging signal having a droplet charging signal amplitude, a droplet charging signal phase and a droplet charging signal frequency, thereby creating a population of charged droplets in each stream of droplets;

c. imposing on each of a second plurality of streams of droplets a corresponding third plurality of calibration signals, the second plurality being a subset of the first plurality, each of the third plurality of calibration signals having a calibration signal frequency, a calibration signal amplitude and a calibration signal phase, each calibration signal phase being independent of any of the droplet charging signals;

d. deflecting from each stream of the first plurality at least a sub-population of charged droplets to a charge detection means;

e. obtaining from the charge detection means a fourth plurality of signature signals corresponding to the third plurality of the calibration signals, each of the fourth plurality of signature signals having a signature signal frequency, a signature signal amplitude and a signature signal phase, the signature signal frequency of each member of the fourth plurality being equal to the calibration signal frequency of the corresponding member of the third plurality; and f. maximizing the charge on the population of charged droplets in each stream of the first plurality of streams of droplets based on the difference between the signature signal phase of at least one member of the fourth plurality and the calibration signal phase of the corresponding member of the third plurality.

28. A method as in claim 27, wherein maximizing the charge comprises minimizing a difference between the signature signal phase of at least one member of the fourth plurality and the calibration signal phase of the corresponding member of the third plurality.

29. A method as in claim 28, wherein generating the first plurality of streams of droplets comprises using at least one droplet stimulation signal and minimizing the difference between the signature signal phase of at least one member of the fourth plurality and the calibration signal phase of the corresponding member of the third plurality comprises adjusting at least one of: the phase of the at least one droplet stimulation signal, the amplitude of the at least one droplet stimulation signal, and the droplet charging signal phase.

30. A method as in claim 29, wherein adjusting at least one of: the phase of the at least one droplet stimulation signal, the amplitude of the at least one droplet stimulation signal, and the droplet charging signal phase is performed automatically.

31. A method as in claim 28, wherein, for each of the first plurality of streams of droplets, the corresponding calibration signal from the third plurality is imposed on the stream of droplets at the same point as where the droplet charging signal is applied.

32. A method as in claim 29, wherein minimizing the difference between the signature signal phase of at least one member of the fourth plurality and the calibration signal phase of the corresponding member of the third plurality is done while at least a part of the first plurality of streams of droplets is being applied to a substrate.

33. A method as in claim 29, wherein at least a part of each of the populations of charged droplets is applied to a substrate.

34. A method as in claim 27, wherein the calibration signal frequency of each member of the third plurality is less than 5% of the droplet charging signal frequency.

* * * * *